United States Patent [19]

Stagg

[11] Patent Number: 5,029,641

[45] **Date of Patent: * Jul. 9, 1991**

[54] INVERTED WELLBORE COMPLETION

[75] Inventor: Theodore O. Stagg, Anchorage, Ak.

[73] Assignee: Standard Alaska Production Company, Anchorage, Ak.

[ * ] Notice: The portion of the term of this patent subsequent to Aug. 7, 2007 has been disclaimed.

[21] Appl. No.: 549,543

[22] Filed: Jul. 9, 1990

Related U.S. Application Data

[60] Continuation of Ser. No. 462,621, Jan. 9, 1990, abandoned, which is a division of Ser. No. 134,397, Dec. 17, 1987, abandoned.

[51] Int. Cl.[5] ..... E21B 43/30

[52] U.S. Cl. ..... 166/50; 166/369

[58] Field of Search ..... 166/369, 50, 52; 175/61, 62

[56] References Cited

U.S. PATENT DOCUMENTS

| | | | |
|---|---|---|---|
| 3,713,486 | 1/1973 | Meitzen . | |
| 4,436,165 | 3/1984 | Emery . | |
| 4,444,265 | 4/1984 | Schmidt . | |
| 4,445,574 | 5/1984 | Vann . | |
| 4,519,463 | 5/1985 | Schuh . | |
| 4,601,353 | 7/1986 | Schuh et al. . | |
| 4,605,076 | 8/1986 | Goodhart . | |
| 4,621,691 | 11/1986 | Schuh . | |
| 4,640,359 | 2/1987 | Livesey et al. | 166/50 X |
| 4,646,836 | 3/1987 | Goodhart | 166/50 X |
| 4,703,799 | 11/1987 | Jennings, Jr. et al. | 166/50 X |

OTHER PUBLICATIONS

SPE Paper, 62nd Annual Conference and Exposition, Sep. 27–30, 1987.

*Primary Examiner*—William P. Neuder

[57] ABSTRACT

A method for selectively producing oil from a reservoir containing both oil and gas. A lateral or horizontal wellbore is drilled within the reservoir below the gas-oil interface, and the wellbore has an inverted producing interval that is upwardly inclining towards the tail of the well. The inverted wellbore is drilled and completed in order to improve reservoir drainage by causing gas breakthrough to occur first at the far end of the upwardly inclining producing interval. A fluid restrictor is activated to restrict gas production from this breakthrough area and to permit oil production above the restrictor.

6 Claims, 1 Drawing Sheet

INVERTED WELLBORE COMPLETION

This is a continuation of copending application Ser. No. 07/162,621 filed on Jan. 9, 1990 now abd. which is a devisional of patent application Ser. No. 07/134,397 filed Dec. 17, 1987 now abd.

BACKGROUND OF THE INVENTION

1. Field of the Invention

The present invention relates generally to a method for producing hydrocarbons from a reservoir traversed by a lateral or horizontal wellbore. More particularly, the subject invention concerns a wellbore having an inverted or upwardly inclining producing interval and a method for drilling, completing, and producing from such a wellbore.

2. Description of the Related Art

A conventional method to produce hydrocarbons has been to drill a wellbore in an essentially vertical direction through the subterranean reservoir. In reservoirs that are relatively thin, this method exposed only a small portion of the pay zone, or producing formation, to the wellbore. Premature gas coning and/or water coning in such wells often reduced the amount of oil that could be recovered.

Within the past decade it has become increasingly common to drill at least a portion of the wellbore so that it intersects the reservoir at an angle to the vertical. In some cases this is a high angle of from 83 to about 88 degrees, or even horizontal. High angle or horizontal sections can then be extended laterally through the pay zone 1000 to 3000 feet or more, or through a plurality of pay zones which may be separated by fault blocks, shale stringers, or other barriers to horizontal or vertical permeability. Development of high angle drilling techniques has meant that more of the pay zone can be exposed to the wellbore, and that oil can be produced at a faster rate while potentially recovering more of the original oil in place than would be otherwise possible with a conventional directional well (less than 83 degrees).

Despite the advantages of high angle wells, they present unique problems and challenges. A driller is allowed a very small margin of error in placing the wellbore within the vertical target range, particularly if the pay zone is thin, faulted, or dipping. For reservoirs having two or more fluids, it is also desirable to locate the completed zones of the wellbore some distance away from the gas-oil or oil-water interfaces to minimize the chances of premature gas or water coning.

Coning in a high angle oil well can be a serious problem. Gas cone breakthrough normally occurs at the highest (shallowest) point in the wellbore that is open to production, and water cone breakthrough normally occurs at the lowest (deepest) point open to production. The gas or water dilutes the oil to the extent that continued production from the well becomes uneconomic.

Downwardly inclining completion intervals lend themselves more readily to the mechanical regulation of water coning. Mechanical regulation of gas coning is more difficult to accomplish by current industry methods. Gas coning in a high angle or horizontal well can be difficult or impossible to repair if the gas entry point occurs at or near the beginning of the producing interval. It is therefore desirable to keep the potential for coning, especially gas coning, to a minimum.

SUMMARY OF THE INVENTION

The present invention concerns a wellbore and method for selectively producing oil from a subterranean reservoir having both oil and gas and a gas-oil interface. The invention comprises drilling a wellbore within the reservoir from a first point located below the interface to a second point, where the second point is higher relative to the first point, completing at least a portion of the wellbore between the first and second points to allow oil to flow from the reservoir into the wellbore and the to earth's surface, and subsequently restricting the passage of gas through the wellbore with at least one fluid restrictor means located between the first and second points to thereby decrease the production of gas downhole from said restrictor means.

Accordingly, the invention provides a fluid production well comprising a subterranean reservoir which contains gas, oil and a gas-oil interface, and a wellbore traversing the subterranean reservoir, the wellbore including a primary producing zone which is completed between first and second points to allow gas and/or oil to flow from the reservoir into the wellbore. The first point is located below the gas-oil interface and the second point is downhole from the first point and higher relative to the first point. At least one restrictor is located between the first and second points for at least partially restricting the production of gas downhole from the restrictor.

DESCRIPTION OF THE PREFERRED EMBODIMENTS

The invention generally concerns producing hydrocarbons from a wellbore which traverses the reservoir from a first point to a relatively higher second point, as explained in detail below.

Certain terms of orientation used in this patent shall adopt the following meanings: Vertical shall refer to the earth's radius, i.e., a line from any selected point on the earth's surface to the earth's center. Horizontal shall mean perpendicular to the earth's radius. The term "lateral" shall generally refer to directions that are horizontal, approximately horizontal, or highly deviated from vertical. The term "downhole" refers to a direction farther from the earth's surface measured along the path of the wellbore; its opposite is "uphole." The terms "lower" and "higher" refer to positions closer or farther, respectively, to the earth's center (regardless of the distance as measured from the earth's surface along the wellbore path).

Figure 1:
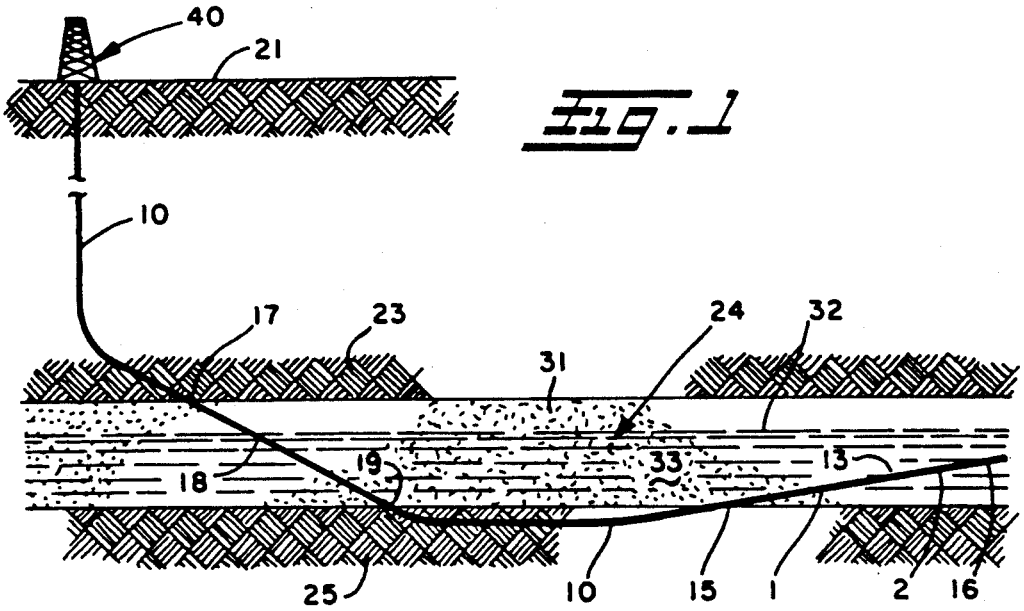
FIG. 1 shows a cross-section of the earth with a wellbore penetrating a reservoir which contains gas and oil.

Referring to the drawings, FIG. 1 depicts a cross-section of a well drilled and completed according to this invention. The distances are not to scale. A wellbore 10 extends from a drilling rig 40 at the earth's surface 21 to a reservoir 24. The reservoir 24 contains both oil 23 and gas 31 which meet at an interface 32. The reservoir is bounded by overlaying and underlaying strata 23 and 25 which, in this example, are horizontal. In an undisturbed reservoir having homogenous permeability characteristics, the gas-oil interface 32 would also be expected to be horizontal.

The wellbore leading from the earth's surface 21 to near the reservoir is drilled and completed with coventional methods. This portion of the wellbore can be essentially vertical, at a slight angle, or lateral as it approaches the reservoir. In some cases the wellbore could extend below the reservoir and approach the target zone from below.

The wellbore may enter the reservoir initially from any angle and direction. In a preferred optional embodiment shown in FIG. 1, the wellbore 10 passes through the reservoir in two separate locations, between points 17 and 19, and again beginning at point 15. After the wellbore is drilled between points 17 and 19 (the alternate or secondary zone), the well can be logged to determine useful reservoir information such as the location of the gas-oil interface and the precise orientation of reservoir strata. The remainder of the wellbore through the primary target zone can then be drilled with better accuracy.

In an optional embodiment shown in FIG. 1, the wellbore 10 dips below the reservoir 24 and follows a lateral path for some distance through the underlaying stratum 25. Stratum 25 as illustrated is similar to stratum 23, but could consist of any type of formation including water-bearing rock. Drilling below the reservoir 24 will often allow the wellbore to enter the reservoir 24 at a location 15 which is set at the maximum vertical distance from the gas-oil interface 32.

Within the reservoir, the wellbore 10 is drilled so that a first point 1 along the wellbore path is relatively lower than a second point 2. "First point" and "second point" refer to the sequence in which the points are encountered along the wellbore path drilled from earth's surface. Their positions are relative only to each other, and it is thus possible that other points along the wellbore could be higher or lower than the first or second points. In a reservoir having a relatively horizontal gas-oil interface (as shown in FIG. 1), the second point 2 is physically higher than the first point 1 and is therefore situated closer to the interface.

A wellbore is generally drilled with the objective of draining as much of the oil as possible while avoiding problems of gas or water breakthrough. Thus in a lateral well through an oil and gas reservoir the wellbore path is planned so that is has a large standoff from the gas/oil interface. If the reservoir also contains water, this path might be adjusted to maintain some distance from the oil/water interface, taking into consideration the reservoir characteristics.

The benefits of this invention can be realized when at least a portion of the wellbore within the reservoir has a second point that is higher than a first point. The entire wellbore within the reservoir may slope upward at an angle from horizontal, as shown between points 15 and 16. Alternatively, a minor or major portion may initially traverse the reservoir horizontally or laterally for up to hundreds or even thousands of feet, and then turn higher to approach the interface 32. The angle chosen will depend primarily upon the thickness of the reservoir, with thin reservoirs requiring only a slight angle above horizontal. For larger reservoirs of 100 feet or more in thickness, the wellbore angle can be maintained at higher angles, e.g. 92 to 97 degrees, over long lateral distances. The tail 16 of the well is preferably, but need not be, at the highest point.

In an alternate embodiment (not illustrated), the wellbore could be directed upward or downward a plurality of times which would result in have several pairs of low and high points along its path, and thus a plurality of "first" and "second" points. This could also occur, for example, in reservoirs which are highly faulted so that the wellbore must go higher or lower to follow the pay zones.

The method of completion chosen will, of course, depend upon the individual characteristics of the reservoir. These methods are conventional and well known. For example, the wellbore can remain completely open to the producing formation in an "open-hole" completion. A liner or casing could also be placed in the wellbore, as is practiced in the art. The two characteristics necessary for the particular completion method are that it permit the initial flow of hydrocarbons through the wellbore, and that it facilitate or at least not impede the subsequent ability to restrict the flow of fluids between a first point and a second higher point, as described in this specification.

In FIG. 1, the well is completed between points 1 and 2, although in practice the completion zone could extend along through the entire reservoir (e.g., between points 15 and 16) or any portion thereof.

Figure 2:
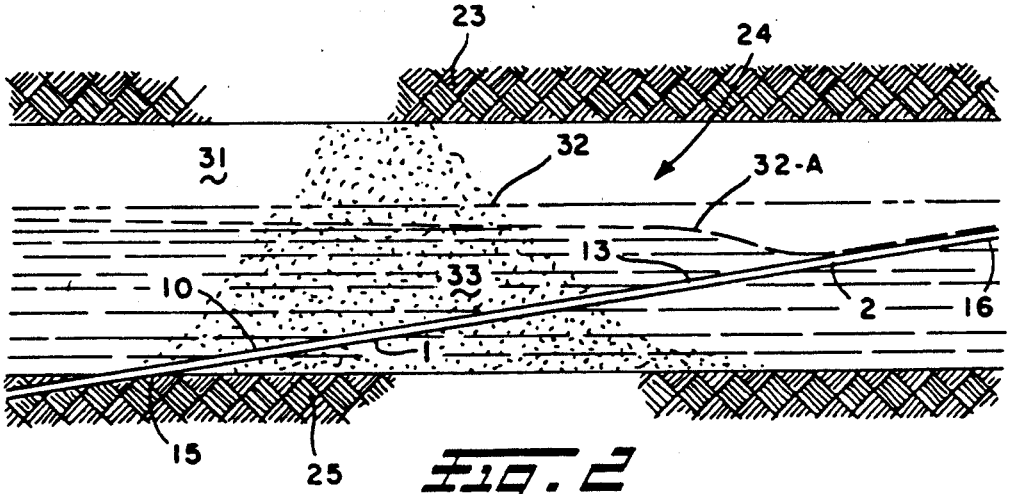
FIG. 2 is an enlargement of the reservoir and wellbore as in FIG. 1, but also showing a change in the location of the gas-oil interface.

Referring to FIG. 2, the pressure differential between the reservoir 24 and the wellbore 10 allows oil 33 to flow and be produced through the wellbore. As oil is produced, the gas 31 typically expands in volume and the original gas-oil interface 32 moves to a new location 32-A closer to the wellbore 10. Because a pressure sink typically develops in the near wellbore region, the gas-oil interface would be distorted and gas breakthrough would be expected to initially occur near the highest section of the wellbore producing interval, here shown near point 2. The well then usually produces a mixture of oil and gas.

When gas breakthrough occurs along one portion of the wellbore, it may be desirable to isolate that portion, especially when it affects economic production of the well. The flow of fluid can be completely or partially restricted by one or more fluid restriction means 13 ("restrictor"), which are well known in the art, situated between the first point 1 and second point 2. With the flow of gas and/or oil thus decreased downhole from the restrictor, oil from the remainder of the producing interval can be selectively produced.

As one example, the restrictor 13 can consist of a permanent bridge plug installed at any point in the liner or casing between points 1 and 2, if the intent is to permanently block the wellbore. Alternatively, the restrictor can be a temporary plug set in any number of casing profiles pre-installed in the well liner or casing, although this is less preferred. Such temporary plugs can would be installed via coiled tubing, snubbing unit, or workover rig.

The restrictor 13 can optionally be designed to only partially restrict the production of fluid and thus cause only a relative decrease in production from the area behind the flow restrictor. For example, one or more permanent packers equipped with a flow restricting orifice could be installed at any point between 1 and 2. A retrievable orifice could also be installed in one or more liner profiles which would be placed at preselected points in the production liner.

Referring to an optional embodiment of the invention shown in FIG. 1, a secondary zone such as the interval between points 18 and 19 is also completed for oil production, usually when production from the primary zone (between 15 and 16) must be severely restricted or abandoned. If all of the primary zone area is to be abandoned, the well can be plugged back at a point between 15 and 19, or even higher. Abandonment of the inverted section is preferably accomplished by setting a permanent bridge plug just below the lowermost zone to be completed in the conventional portion of the well: 18 to 19.

Figure 3:
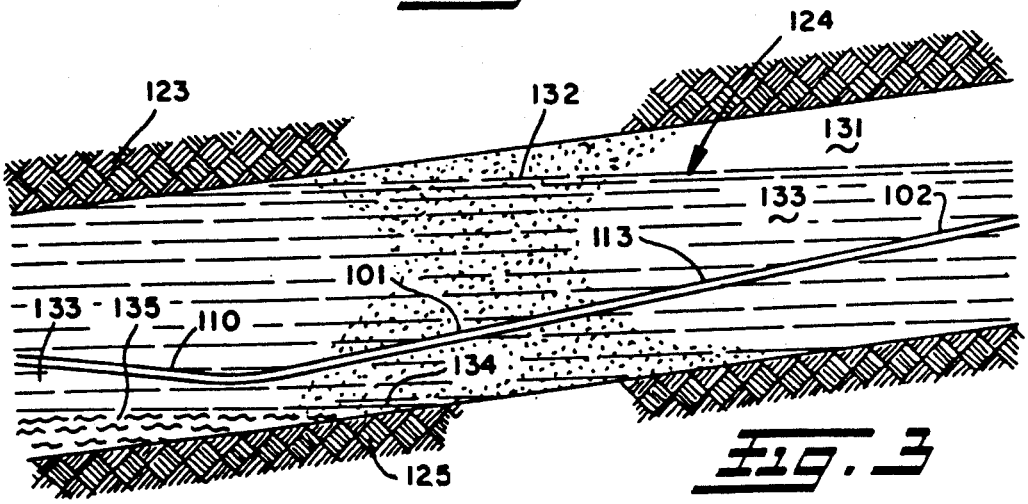
FIG. 3 shows an alternative embodiment of the invention in a tilted reservoir.

FIG. 3 illustrates the invention in a reservoir having strata 123, 124, and 125 tilted at an angle to horizontal, gas 131 and oil 133 meeting at interface 132, and water 135 meeting the oil 133 at interface 134. The wellbore 110 preferably follows a path designed to maintain a calculated distance from the oil-water interface 134, a first point 101 is drilled, and subsequently a second point 102. The wellbore can be restricted between the first and second points, by engaging a restrictor 113.

Although the invention has been described by reference to only a few embodiments, it is not intended that the invention be so limited. Modifications to these embodiments are intended to be included as falling within the broad scope of the disclosure and the claims.

I claim:

1. A fluid production well including a subterranean reservoir which contains gas, oil and a gas-oil interface, and a wellbore traversing said subterranean reservoir, said wellbore including a primary producing zone which is completed between first and second points to allow gas and/or oil to flow from the reservoir into the wellbore, the first point being located below the gas-oil interface and the second point being downhole from the first point and being higher relative to the first point, and at least one restrictor means located between the first and second points for at least partially restricting the production of gas downhole from said restrictor means.

2. The fluid production well of claim 1, in which the wellbore further includes a secondary producing zone at a location uphole from the primary producing zone.

3. The fluid production well of claim 1, in which the restrictor means completely restricts production of gas downhole from the restrictor means.

4. The fluid production well of claim 3, in which the restrictor means includes a permanent bridge plug.

5. The fluid production well of claim 1, in which the restrictor means includes a packer containing a flow-restricting orifice.

6. The fluid production well of claim 1, in which the angle of the wellbore between the first and second points is about 92°–97° from vertical.

* * * * *